US005529522A

United States Patent [19]

Huang

[11] Patent Number: 5,529,522

[45] Date of Patent: Jun. 25, 1996

[54] ELECTRICAL CONNECTOR

[76] Inventor: Chung-Chuan Huang, No. 245, Da Wu Street, Tainan, Taiwan

[21] Appl. No.: 404,498

[22] Filed: Mar. 17, 1995

[51] Int. Cl.[6] ..... H01R 9/05; H01R 17/04

[52] U.S. Cl. ..... 439/460; 439/440; 439/441; 439/578; 439/580

[58] Field of Search ..... 439/438, 439, 439/441, 440, 580, 578, 98, 460

[56] References Cited

U.S. PATENT DOCUMENTS 5,151,053 9/1992 Shinji et al. ..... 439/98
5,183,411 2/1993 Yu ..... 439/578

*Primary Examiner*—P. Austin Bradley
*Assistant Examiner*—T. C. Patel
*Attorney, Agent, or Firm*—Morton J. Rosenberg; David I. Klein

[57] ABSTRACT

An electrical connector for securing a cable having a insulation and a cover engaged on the insulation, the electrical connector includes a clamping member , a spring, a cone, another clamping member and a pusher engaged in a cylindrical body. The clamping members each includes a number of clamping blades for clamping the insulation and the cover in place. The pusher includes one end for expanding the clamping blades of one of the clamping members and may push the cone to expand the clamping blades of the other clamping member in order to release both the cover and the insulation.

5 Claims, 5 Drawing Sheets

ELECTRICAL CONNECTOR

BACKGROUND OF THE INVENTION

1. Field of the Invention

The present invention relates to a connector, and more particularly to an electrical connector.

2. Description of the Prior Art

A typical electrical connector is shown in FIG. 1 and comprises a body 20 including a screw 22 threadedly engaged therewith and including a tube 21 extended therefrom. A cable 10 includes a wire 11 having insulation 12 formed of an insulating material such as plastic and the like; and includes a electrical conductible shield braiding 13 engaged on the insulation 12 and having a cover 14 provided thereon. The wire 11 and the insulation 12 are engaged into the tube 21 of the body 20; and the electrical conductible shield braiding 13 is then fixed to the body 20 by a clamping ring 23 which is fixed to the body 20 by plier means.

Another typical electrical connector is shown in FIG. 2 and comprises a body 30 including a terminator 31 extended therefrom and including an outer thread 32 for engaging with a shell 37. The body 30 further includes a socket 33 for engaging with the wire 11 and includes a bracket 34 secured thereto. The bracket 34 includes a clamping ring 35 for clamping the cover 14; and includes an ear 36 for securing with the electrical conductible shield braiding 13. In both of the electrical connectors, the cable 10 may not be easily coupled to the bodies 20, 30. In addition, when the cable 10 is secured to the bodies 20, 30, the cable 10 may not be easily removed or disengaged from the bodies 20, 30.

The present invention has arisen to mitigate and/or obviate the afore-described disadvantages of the conventional electrical connectors.

SUMMARY OF THE INVENTION

The primary objective of the present invention is to provide an electrical connector to which the cable can be easily secured.

In accordance with one aspect of the invention, there is provided an electrical connector for securing a cable including a wire, insulation engaged on the wire, a shield braiding engaged on the insulation and a cover engaged on the shield braiding. The electrical connector comprises a sleeve including a first end portion, a jacket engaged on the first end portion of the sleeve, a body engaged in the first end portion of the sleeve and including a first end located close to the jacket and including a second end distal to the jacket, a first clamping member engaged in the second end of the body and including a plurality of clamping blades for clamping the insulation in place, a cone engaged in the body for electrically engaging with the shield braiding and including a first end for engaging with the first clamping member and for expanding the clamping blades when the cone moves toward the first clamping member, means for biasing the cone away from the first clamping member, a second clamping member engaged in the first end of the body and engaged with the cone and including a plurality of clamping blades for clamping the cover in place, and a pusher engaged in the first end of the body and including a first end having a tapered surface formed thereon for engaging with the second clamping member and for expanding the clamping blades of the second clamping member when the pusher moves toward the second clamping member, the pusher including a knob extended in the jacket. The clamping blades of the second clamping member are expanded by the tapered surface of the pusher when the pusher is moved inwards of the sleeve in order to release the cover, and the clamping blades of the first clamping member are expanded by the cone when the cone is pushed toward the first clamping member by the first clamping member in order to release the insulation.

The jacket includes a first end for engaging with the sleeve and includes a second end having an opening formed therein for engaging with the cable and having at least one sealing ring formed therein for engaging with the cover of the cable.

The body includes an annular shoulder formed in the second end for engaging with the first clamping member so as to retain the first clamping member in the body.

A disc is engaged in the sleeve and engaged with the second end of the body, the disc includes a bore formed therein, and a tube is engaged in the bore of the disc for engaging with the wire.

A washer is engaged between the cone and the second clamping member, a ring is engaged in the first end of the body and includes a first annular shoulder formed therein, the pusher includes a second annular shoulder formed therein for engaging with the first annular shoulder of the ring so as to secure the pusher to the ring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
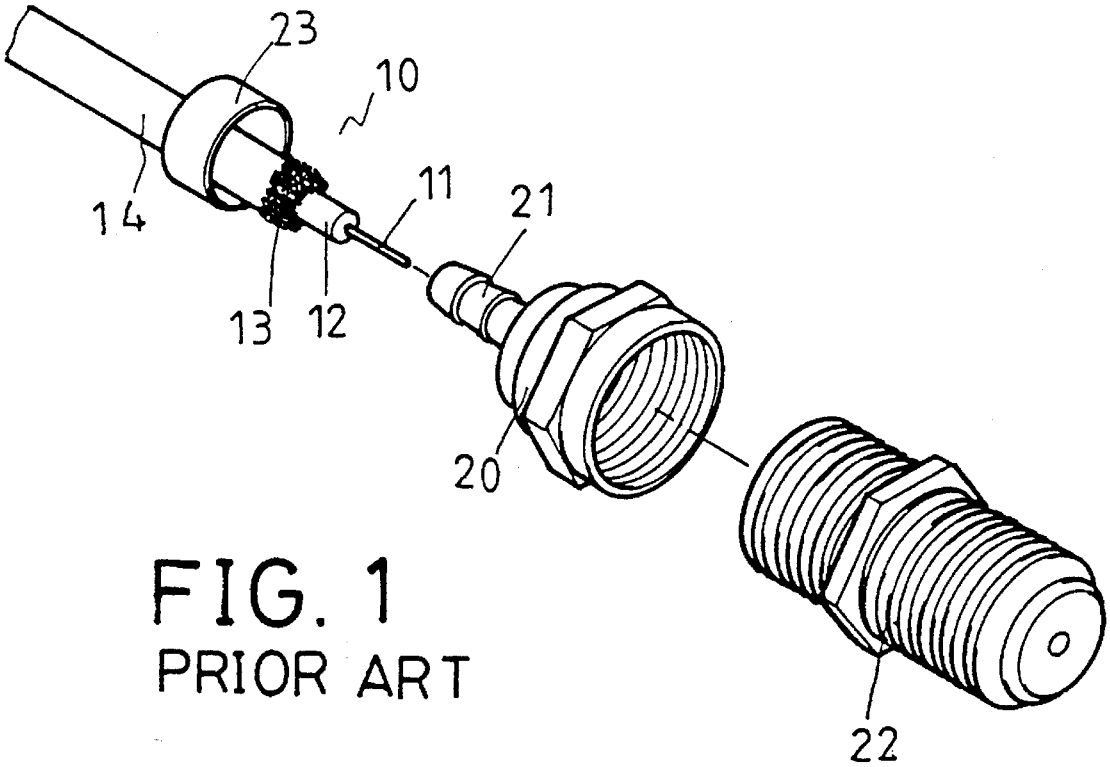
FIG. 1 PRIOR ART
FIGS. 1 and 2 are exploded views illustrating two typical electrical connectors.
Figure 2:
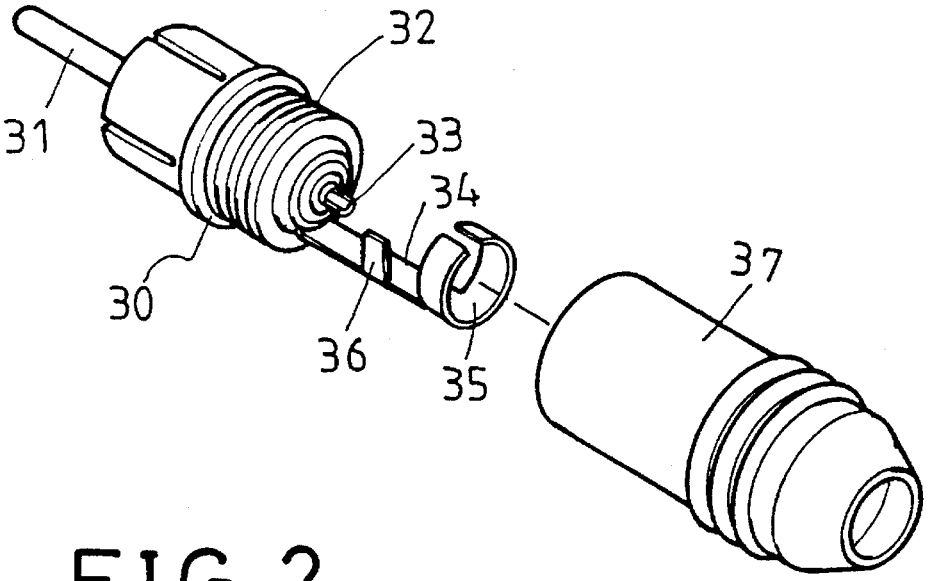
FIG. 2 PRIOR ART
Figure 3:
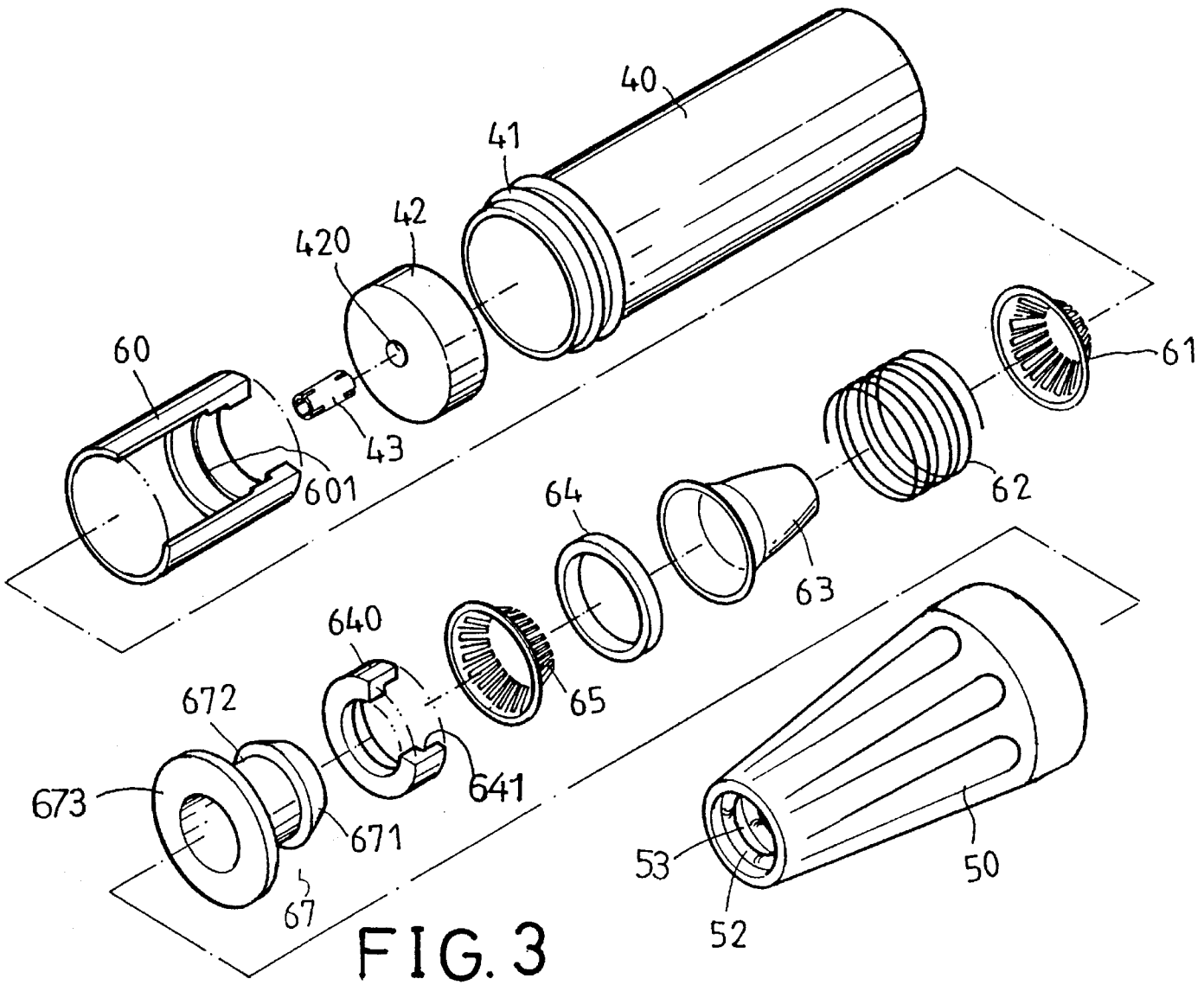
FIG. 3 is an exploded view of an electrical connector in accordance with the present invention.
Figure 4:
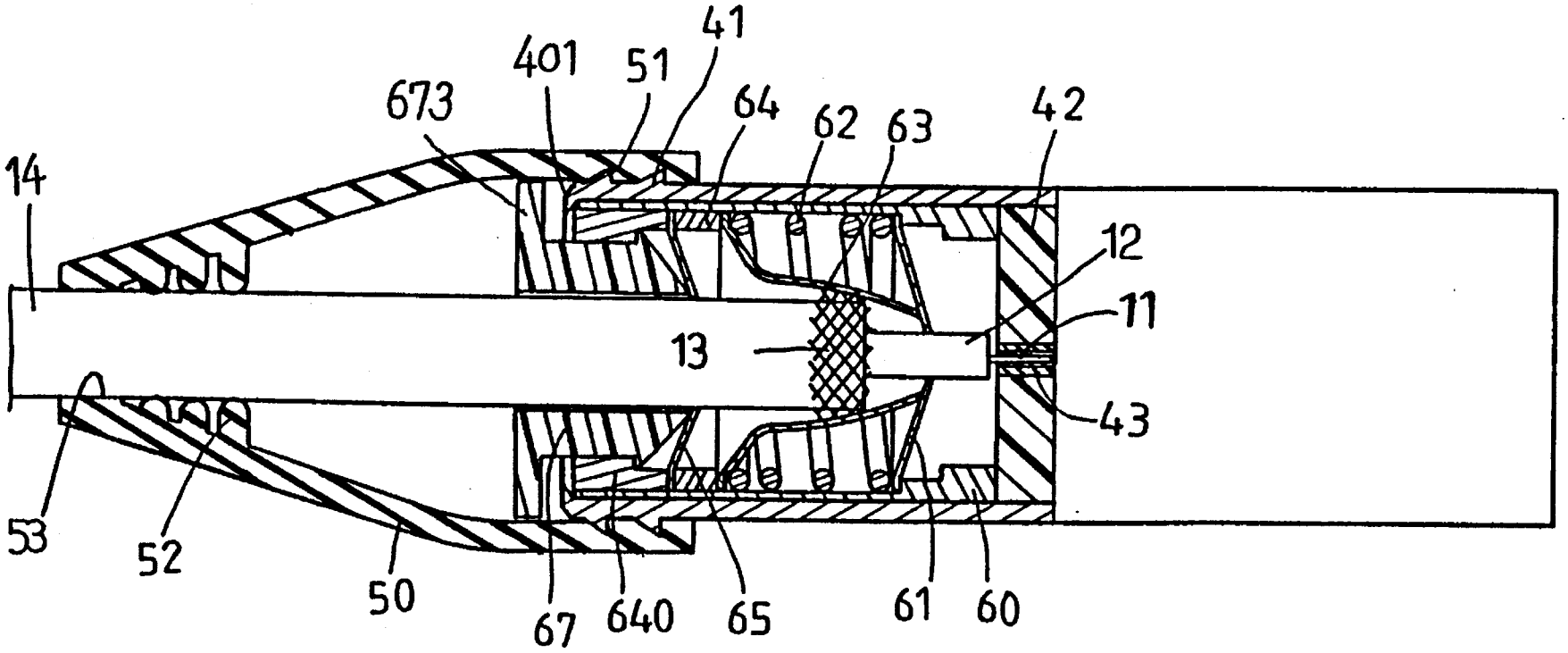
FIGS. 4 and 5 are cross sectional views of the electrical connector.

Referring to the drawings, and initially to FIGS. 3 and 4, an electrical connector in accordance with the present invention comprises a cylindrical body 60 including one or more annular shoulders 601 formed therein and including a sleeve 40 engaged thereon. The sleeve 40 includes one or more ratchet teeth 41 formed on one end thereof for engaging with annular grooves 51 formed in a jacket 50. The jacket 50 is preferably made of soft and resilient material such as rubber materials and includes a free end portion having an opening 53 formed therein and having a number of annular sealing rings 52 formed therein. The jacket 50 may be provided for covering the end portion of the sleeve 40. A disc 42 is engaged in the sleeve 40 and engaged with the cylindrical body 60, and includes a bore 420 for engaging with a tube 43 which is electrical conductive and which is preferably made of copper materials. The sleeve 40 may include an annular flange 401 extended radially inward therefrom for engaging with the body 60 and for retaining the body 60 within the sleeve 40.

A frustum shaped clamping member 61 is engaged in the cylindrical body 60 and engaged with the annular shoulder 601 of the cylindrical body 60 such that the clamping member 61 may be stably retained in the cylindrical body 60. The clamping member 61 includes a number of clamping blades 610 each having an angular shaped tip 611 for engaging with the insulation 12 and for resiliently clamping the insulation 12 in place. A cone 63 is engaged in the cylindrical body 60 and includes one end of smaller diameter engaged with the clamping member 61. The cone 63 is made of electrical conductive materials for electrically engaging with the electrical conductible shield braiding 13. A spring 62 is biased between the cone 63 and the clamping member 61. A washer 64, another clamping member 65 and a ring 640 are engaged in the body 60 and engaged with the cone 63. The ring 640 includes an annular shoulder 641 formed therein for engaging with a pusher 67 which includes a tapered surface 671 for engaging into the ring 640 and for engaging with the clamping member 65 and which includes an annular shoulder 672 for engaging with the annular shoulder 641 of the ring 640. The clamping member 65 also includes a number of clamping blades 610 for clamping the cover 14 in place. The pusher 67 includes a knob 673 extended outward of the sleeve 40 and located in the jacket 50.

As shown in FIG. 4, the cable 10 may be easily engaged into the jacket 50, and the wire 11 may be easily engaged in the tube 43. The insulation 12 and the cover 14 can be solidly retained in place by the clamping members 61, 65 and can be prevented from disengaging from the clamping members 61, 65.

Figure 5:
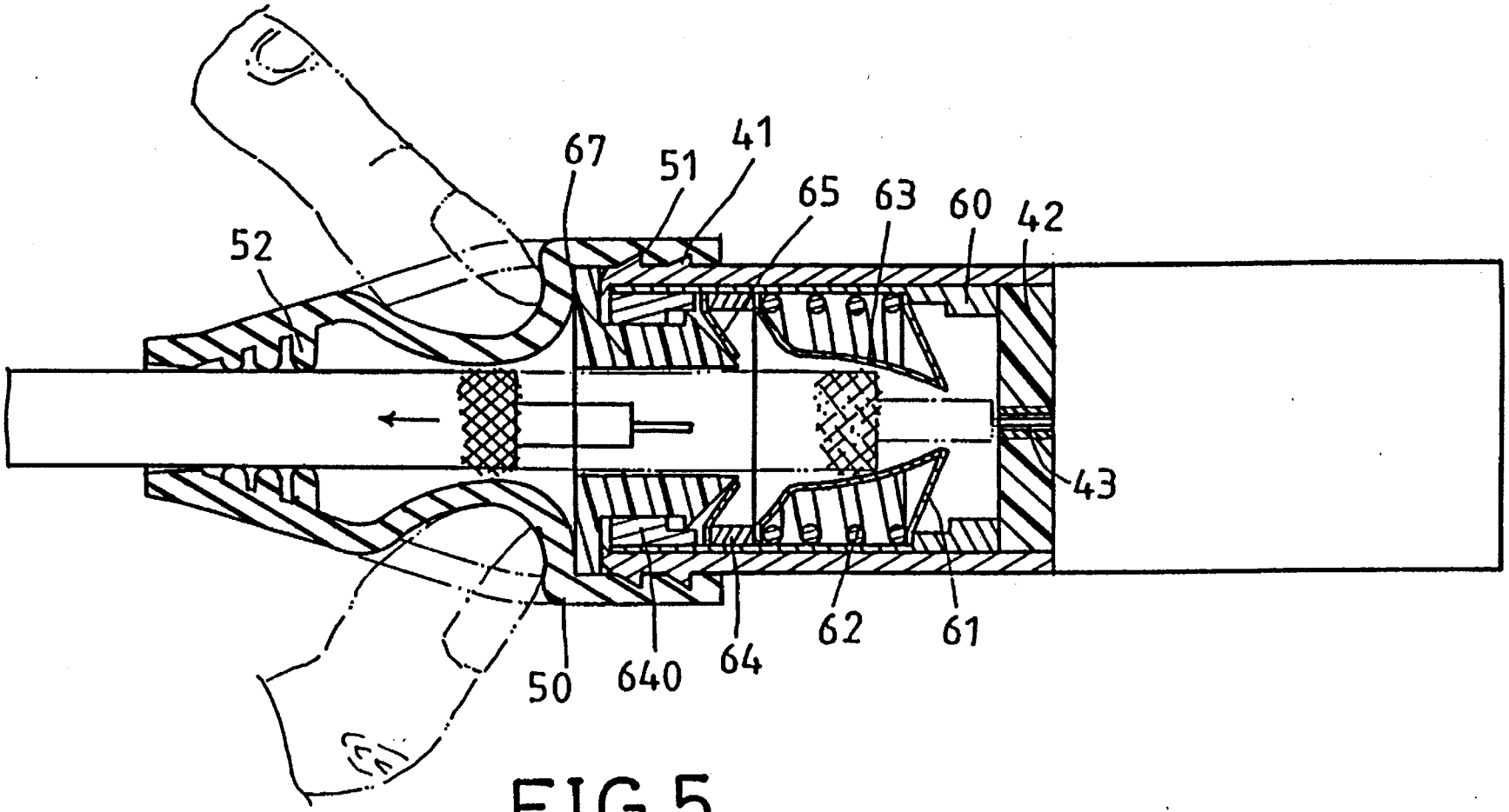

Referring next to FIG. 5, the pusher 67 may be forced toward the cone 63 in order to expand the blades 610 of the clamping member 61. The cone 63 may also be moved inwards of the body 60 by the pusher 67 in order to expand the other clamping member 61 such that both the cover 14 and the insulation 12 may be released and such that the cable 10 may be easily removed or disengaged from the body 60.

Figure 6:
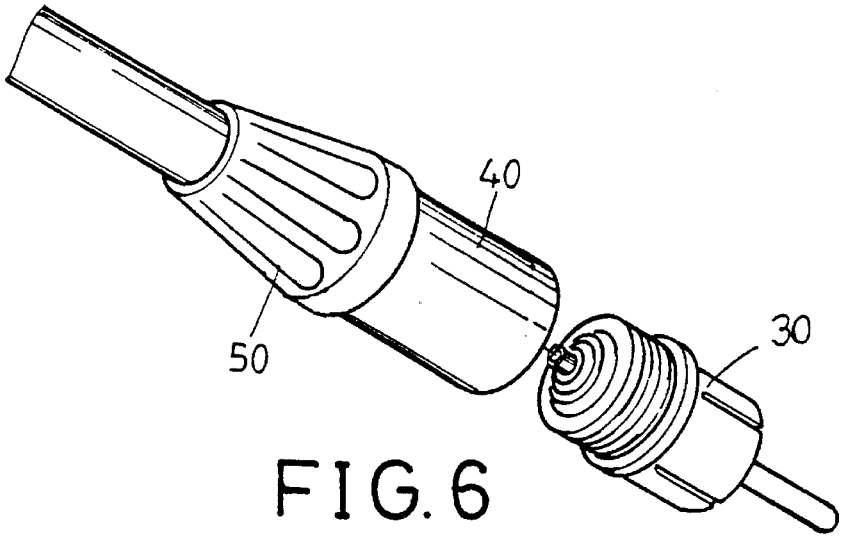
FIGS. 6 and 7 are perspective views illustrating the operation of the electrical connector.
Figure 7:
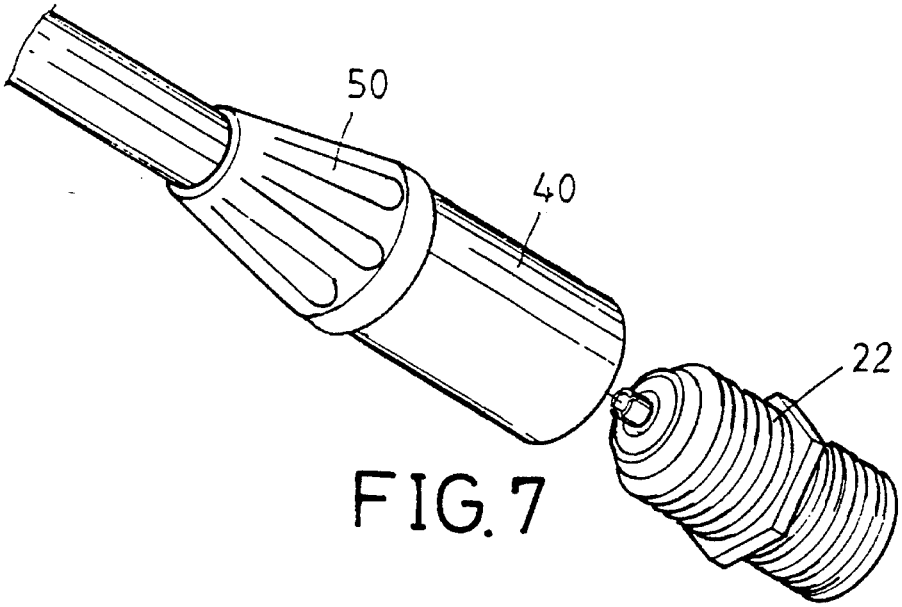
Figure 3A:
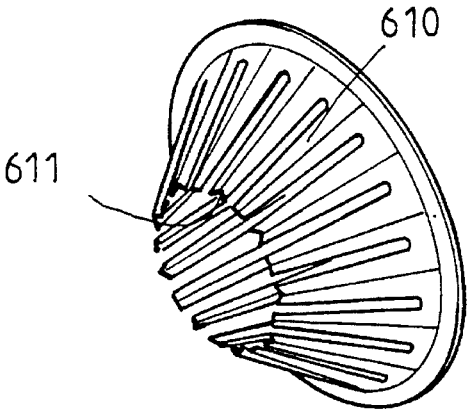
FIG. 3A is a perspective view illustrating a clamping member.

Referring next to FIGS. 6 and 7, the conventional plug type connector 30 (FIG. 6) or the conventional screw type connector 22 (FIG. 7) may be easily engaged into the sleeve 40.

Accordingly, the electrical connector in accordance with the present invention includes two clamping members for clamping the cable and includes a pusher for expanding the clamping members for releasing the cable.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electrical connector for securing a cable including a wire, insulation engaged on said wire, a shield braiding engaged on said insulation and a cover engaged on said shield braiding, said electrical connector comprising:

a sleeve including a first end portion, a jacket engaged on said first end portion of said sleeve, a body engaged in said first end portion of said sleeve and including a first end located close to said jacket and including a second end distal to said jacket, a first clamping member engaged in said second end of said body and including a plurality of clamping blades for clamping said insulation in place, a cone engaged in said body for electrically engaging with said shield braiding and including a first end for engaging with said first clamping member and for expanding said clamping blades when said cone moves toward said first clamping member, means for biasing said cone away from said first clamping member, a second clamping member engaged in said first end of said body and engaged with said cone and including a plurality of clamping blades for clamping said cover in place, and a pusher engaged in said first end of said body and including a first end having a tapered surface formed thereon for engaging with said second clamping member and for expanding said clamping blades of said second clamping member when said pusher moves toward said second clamping member, said pusher including a knob extended in said jacket, said clamping blades of said second clamping member being expanded by said tapered surface of said pusher when said pusher is moved inwards of said sleeve in order to release said cover, and said clamping blades of said first clamping member being expanded by said cone when said cone is pushed toward said first clamping member by said second clamping member in order to release said insulation.

2. An electrical connector according to claim 1, wherein said jacket includes a first end for engaging with said sleeve and includes a second end having an opening formed therein for engaging with said cable and having at least one sealing ring formed therein for engaging with said cover of said cable.

3. An electrical connector according to claim 1, wherein said body includes an annular shoulder formed in said second end for engaging with said first clamping member so as to retain said first clamping member in said body.

4. An electrical connector according to claim 1 further comprising a disc engaged in said sleeve and engaged with said second end of said body, said disc including a bore formed therein, and a tube engaged in said bore of said disc for engaging with said wire.

5. An electrical connector according to claim 1 further comprising a washer engaged between said cone and said second clamping member, a ring engaged in said first end of said body and including a first annular shoulder formed therein, said pusher including a second annular shoulder formed therein for engaging with said first annular shoulder of said ring so as to secure said pusher to said ring.

* * * * *